US008763653B2

(12) United States Patent
Weigel et al.

(10) Patent No.: US 8,763,653 B2
(45) Date of Patent: Jul. 1, 2014

(54) FILLING ASSEMBLY FOR METERING POWDER AND METHOD FOR OPERATING SUCH A FILLING ASSEMBLY

(75) Inventors: Marco Weigel, Backnang (DE); Katharina Hell, Stuttgart (DE)

(73) Assignee: Harro Höfliger Verpackungsmaschinen GmbH, Allmersbach im Tal (DE)

( * ) Notice: Subject to any disclaimer, the term of this patent is extended or adjusted under 35 U.S.C. 154(b) by 347 days.

(21) Appl. No.: 13/389,004

(22) PCT Filed: Aug. 6, 2009

(86) PCT No.: PCT/EP2009/005685

§ 371 (c)(1),
(2), (4) Date: Feb. 6, 2012

(87) PCT Pub. No.: WO2011/015217

PCT Pub. Date: Feb. 10, 2011

(65) Prior Publication Data

US 2012/0132314 A1 May 31, 2012

(51) Int. Cl.
*B65B 1/36* (2006.01)

(52) U.S. Cl.
CPC ..... *B65B 1/36* (2013.01)
USPC ..... 141/81; 141/12; 141/71

(58) Field of Classification Search
CPC ..... B65B 1/30; B65B 1/36
USPC ..... 141/11–12, 71–72, 81
See application file for complete search history.

(56) References Cited

U.S. PATENT DOCUMENTS

| | | | | |
|---|---|---|---|---|
| 5,339,871 | A * | 8/1994 | Collins et al. | 141/81 |
| 6,179,015 | B1 | 1/2001 | Kammler et al. | |
| 6,340,036 | B1 * | 1/2002 | Toyoizumi et al. | 141/275 |
| 6,679,301 | B2 * | 1/2004 | Makino et al. | 141/71 |
| 7,836,922 | B2 * | 11/2010 | Poole et al. | 141/72 |

(Continued)

FOREIGN PATENT DOCUMENTS

| | | | |
|---|---|---|---|
| DE | 22 31 040 | A1 | 1/1974 |
| DE | 102 51 965 | A1 | 5/2004 |
| EP | 1 000 859 | A1 | 5/2000 |
| WO | 2009/046728 | A1 | 4/2009 |

*Primary Examiner* — Gregory Huson
*Assistant Examiner* — Nicolas A Arnett
(74) *Attorney, Agent, or Firm* — Gudrun E. Huckett

(57) ABSTRACT

The invention relates to a filling assembly for volumetric metering of fine grained powder (2) and to a method for operating said filling assembly. The powder (2) is provided in a resting state in the storage container (15) arranged on the inlet side of a filling line (8), and in the filling line (8) itself. The filling device (1) has a cover (7), a filling line (8) led through the cover (7) and pressure line (9), and also a pressure pulsation device (10). A metering container (3) is moved with its filling opening (5) under the cover (7) of the filling device (1) in such a way that the filling line (8) and the pressure line (9) open into the interior (4) of the metering container (3). By means of the pressure pulsation device (10), a pressure (p) oscillating about the atmospheric ambient pressure ($p_o$) as an average is generated and, by means of the pressure line (9), is transmitted into the interior (4) of the metering container (3). Amplitude (a), frequency and period (t) of the oscillating pressure (p) are adjusted in such a way that the powder (2) in the filling line (8) is fluidized and, as a consequence of its inherent weight, falls through the filling line (8) into the metering container (3).

16 Claims, 1 Drawing Sheet

(56) References Cited

U.S. PATENT DOCUMENTS

| | | | | |
|---|---|---|---|---|
| 7,950,423 | B2 * | 5/2011 | Poole et al. | 141/67 |
| 7,958,916 | B2 * | 6/2011 | Poole et al. | 141/83 |
| 8,025,082 | B2 * | 9/2011 | Poole et al. | 141/12 |
| 8,151,829 | B2 * | 4/2012 | Makino | 141/12 |
| 8,371,342 | B2 * | 2/2013 | Weigel | 141/80 |
| 2002/0144746 | A1 * | 10/2002 | Makino et al. | 141/12 |
| 2008/0202630 | A1 * | 8/2008 | Kax et al. | 141/18 |
| 2010/0212777 | A1 | 8/2010 | Weigel | |

* cited by examiner

FILLING ASSEMBLY FOR METERING POWDER AND METHOD FOR OPERATING SUCH A FILLING ASSEMBLY

BACKGROUND OF THE INVENTION

The invention relates to a filling assembly for volumetric metering of finely divided powder, in particular of medicinal powders for pulmonary administration, comprising a filling device and a metering container with an interior and with a rim circumferentially extending about a fill opening of the metering container, wherein the filling device comprises a cover and at least one filling line passing through the cover, wherein the cover, when filling the metering container, covers the fill opening and the rim, and wherein the filling line, when filling the metering container, opens into the interior. The invention also relates to a method for operating such a filling assembly.

Small quantities of powder, in particular small quantities of medicinal powder or powdery medication, for example, for pulmonary or for transdermal administration, must be metered and packaged in individual doses of a few milligrams or even micrograms suitable for the user. Such metering by weighing is difficult for which reason it is common in such applications to employ volumetric metering.

A known form of volumetric metering is done with a so-called membrane metering device disclosed, for example, in WO 2009/046728 A1. In this connection, a metering container for receiving the powder is provided, for example, in the form of a blister pack or the like with an interior, with a fill opening, and with a rim circumferentially surrounding the fill opening. A filling device that is matched thereto has a cover in the form of an air-permeable membrane that, when filling the metering container, covers the fill opening and its rim. Moreover, a filling line for the powder is provided that passes through the membrane and opens within the container interior when filling the metering container.

For generating the filling process, at the air-permeable membrane an air pressure differential is applied that generates underpressure in the interior of the metering container through the membrane. By means of this underpressure, the powder is sucked from the filling line into the metering container. The membrane is of such a fine-pore structure that air can pass through it for generating the underpressure but that the powder that is entering the interior of the metering container is retained and remains within the interior.

The illustrated assembly has proven successful for filling of the metering container up to the rim. The individual quantities of the powder can be exactly metered. The rim that circumferentially surrounds the fill opening is covered by the membrane during the filling process so that no powder can deposit thereon. The rim can be used without requiring further cleaning action as a seal surface for the later sealing action of the metering container with a heat sealing film.

A problem in this context is however the design of the permeable membrane. Its capillaries can become clogged in case of certain powder compositions so that a correspondingly complex membrane configuration is required. Powder particles that are jammed in the capillaries entail the risk of so-called cross contamination wherein adhering particles are entrained jointly with the membrane and may mix with deviating powder formulations.

Often, there is moreover the need to fill in a precisely metered powder quantity that however does not completely fill the interior of the metering container. Rather, in certain applications it may be required to allow for a certain air volume in the interior of the metering container in addition to the metered powder quantity. This is however difficult to achieve with the aforementioned membrane filling device because the powder quantity entering the interior of the metering container is sucked against the inner surface of the permeable membrane and therefore a filling up to the rim of the metering container is generated.

The object of the invention is to further develop a filling assembly of the aforementioned kind in such a way that its spectrum of use is expanded while a simplified configuration and reliable operation are provided.

SUMMARY OF THE INVENTION

This object is solved by a filling assembly comprising at least one pressure line that passes through the cover and, when filling the metering container, opens into the interior and further comprising a pressure pulsation device for generating a pressure oscillating about the atmospheric ambient pressure as an average value, wherein the oscillating pressure is transmitted through the pressure line.

The invention has further the object to provide a method for operating the aforementioned filling assembly with which a simplified and exact and reliable metering of the powder is enabled.

This object is solved by a method comprising the following steps:

- the powder is provided at rest in a storage container provided at an inlet side of the at least one filling line as well as in the filling line itself in such a way that the powder does not fall as a result of its inherent weight through the filling line;
- the metering container is positioned with its fill opening such underneath the cover of the filling device that a sealing section of the cover is resting seal-tightly on the rim of the metering container and in that the at least one filling line and the at least one pressure line open into the interior of the metering container;
- by means of the pressure pulsation device an oscillating pressure is generated that oscillates about the atmospheric ambient pressure as an average value and, by means of the pressure line, is transmitted into the interior of the metering container;
- amplitude, frequency and duration of the oscillating pressure are adjusted such that the powder in the filling line is fluidized and, as a result of its inherent weight, falls through the filling line into the metering container;
- after reaching a desired powder filling level in the metering container, the oscillating pressure is switched off and the filled metering container is removed.

In this connection, it is proposed that at least one pressure line is provided that passes through the cover and that opens upon filling of the metering container into its interior and in that a pressure pulsation device is provided for generating a pressure that is oscillating about the atmospheric ambient pressure as an average value and wherein the oscillating pressure is transmitted though the pressure line into the interior of the metering container.

In a corresponding operating method, the powder is provided at rest in a storage container arranged at the inlet side of the filling line as well as in the filling line itself such that the powder cannot fall through the filling line because of its inherent weight. The metering container is positioned with its fill opening in such a way underneath the cover of the filling device that the sealing section of the cover rests seal-tightly on the rim of the metering container and that the filling line and the pressure line open in the interior of the metering container. By means of the pressure pulsation device, a pressure that oscillates about the atmospheric ambient pressure as an average value is generated and, by means of the pressure line, is transmitted into the interior of the metering container. Amplitude, frequency, and duration of the oscillating pressure are adjusted such that the powder is fluidized in the filling line and as a result of its inherent weight drops through the filling line into the metering container. After reaching a desired powder filling level in the metering container, the oscillating pressure is switched off and the filled metering container is removed.

The configuration according to the invention provides several advantages at once. The pressure that is oscillating about the atmospheric ambient pressure as an average value and that is introduced into the metering container results in that, based on its average value mentioned here, air can neither pass into the metering container nor can flow out of it on average. In the interior of the metering container a balanced air balance is achieved. Measures for exhausting or venting the interior are not required so that an exhaust or venting filter as a retaining device for the powder is not required. This applies in particular to the cover that must not be designed as a permeable membrane but is preferably a component that, as a whole, is seal-tight relative to air and powder. The danger of capillary clogging and cross contamination does not exist. The constructive configuration is simplified.

Pressure loading of the powder from the end of the container moreover solves the problem of an otherwise possible filling level-caused pressure fluctuation. Since the interior of the metering container at its rim is covered during the filling process by means of the cover of the filling device, a pressure compensation to the exterior is not possible in this state nor is it desired. The powder that is successively falling from the filling line into the interior of the metering container displaces a certain quantity of air, however. Since the powder is however fluidized from the end of the container in the filling line or in the upstream storage container, the powder that is fluidized in this way can take up the displaced air quantity without requiring a pressure compensation. Additional pressure compensation devices with screens or the like as a retaining device for the powder are therefore not required.

The finely divided powder tends to agglomerate all the more the more finely divided it is. In this connection, the configuration according to the invention is in particular suitable for powders with a grain size in the range of including 1 μm to including 80 μm wherein medicinal powders often are a mixture of various kinds of powders. The medicinally active components have in this connection typically a grain size range of including 1 μm to including 20 μm wherein a granular carrier material with a grain size range of including 30 μm to including 80 μm or even up to including 200 μm may be admixed. In any case, a free cross-sectional size of the filling line is matched such to the properties of the powder that the powder with switched-off pressure pulsation device cannot fall because of its inherent weight through the filling line but instead, as a result of its distinct agglomeration tendency, remains stuck.

Only by loading in accordance with the invention with a pulsating pressure, the powder that is stuck in the filling line is fluidized by overcoming the cohesive forces so that, as a result of its inherent weight, it will drop from the filling line into the interior of the metering container. With the start of the pressure pulsation process the powder conveying action into the container interior is triggered and by switching off the pulsating pressure it is immediately interrupted so that precise metering is enabled. For the aforementioned grain size range of the powder, a free cross-sectional size of the filling line in a range of including 0.1 mm to including 5.0 mm, expediently in a range of including 0.5 mm to including 2.0 mm, and preferably in a range of including 1.0 mm to including 1.5 mm, has been found to be advantageous.

A special feature according to the invention resides in that loading of the powder with the pulsating pressure is realized from the end of the metering container or its interior. This arrangement is based on the realization that the powder as a two-phase mixture of powder grains and air has a high inner damping action relative to externally applied mechanical oscillations as a result of inner friction. Since however the pressure loading action and thus the fluidization is realized from the end of the powder opening of the filling line, this damping action is irrelevant for the filling process. The powder is exactly fluidized at the location where its automatic flowing action from the filling line is required. With increasing degree of flow, the compacted solid-like front of the powder migrates backwards in the direction of the storage container but remains, independent of its spatial position, always exposed to the pulsating pressure. Accordingly, a local fluidization is occurring always at places where it is needed, i.e., at the powder front that is facing the metering container from where the individual powder grains are to be released.

With this targeted fluidization, the pressure amplitudes can be kept small which contributes to a gentle treatment of the usually sensitive finely divided powder. Moreover, amplitude, frequency, and duration of the oscillating pressure can be matched almost in any range to the powder consistency that is to be processed, respectively, so that a broad powder spectrum can be metered. The fluidization is realized solely by the oscillating pressure without requiring or using mechanically moved parts. The sensitive powder will not be damaged. By eliminating mechanically moved components, there is no wear that might contaminate the powder. Since the air balance is balanced and no average flow occurs, there is no danger that the powder may segregate so that it is possible without problems to also meter multi-phase powders. Moreover, amplitude, frequency, and duration of the oscillating pressure can be adjusted and used in a way that in the target container or in the metering container the desired powder densities with certain compression ratios and thus exactly determined powder masses can be adjusted.

A further advantage of the design according to the invention resides in the possibility to carry out, as needed, a filling action up to the rim or only a partial filling of the metering container. This can be done in different ways. First, in an advantageous embodiment of the filling assembly, the cover in the area of the fill opening of the metering container can have a cover section and in the area of the rim of the metering container a sealing section wherein the cover section relative to the sealing section is displaced with height offset. Inasmuch as the cover section is height-offset into the interior of the metering container, the free available volume of the container interior is reduced. The reduced volume can then be filled completely with powder. After removal of the filled metering container, relative to the circumferentially extending rim an air-filled additional volume is provided which, with sealed-off rim, results in a fixedly defined partial filling in accordance with a user's desire. On the other hand, it can also be possible to displace with height offset the cover section of the cover relative to the sealing section out of the interior of the metering container so that a targeted overfilling is possible.

Precise metering can be carried out in various method variants. On the one hand, it may be expedient that the interior of the metering container that is delimited by the cover section of the cover is completely filled with the powder wherein after complete filling the oscillating pressure is switched off.

In this context, the powder quantity is defined volumetrically exactly by the geometry of the metering container and the cover section.

On the other hand, for certain kinds of powder it may be expedient that the interior of the metering container that is delimited by the cover section of the cover is only partially filled with the powder and that a time-controlled filling is performed. In this connection, after a time that determines the partial filling, the oscillating pressure is switched off so that the powder flow is interrupted by time control even before the interior of the metering container is completely filled relative to the cover.

For the arrangement of the pressure line and of the filling line relative to each other, different configurations are conceivable. Preferably, the pressure line passes coaxially through the filling line so that the filling line has an annular cross-section. The pulsating pressure that is provided by the pressure line is then immediately made available at the powder opening of the filling line at the end of the container so that an exactly defined interaction between pulsating pressure and the powder occurs.

In this context, it may be expedient to arrange the pressure opening of the pressure line at the container end relative to the powder opening of the filling line at the container end with height offset relative to their axial direction. Preferably, the powder opening and the pressure opening in the operation-ready position relative to the direction of the force of gravity are at the same level; this improves the afore mentioned interaction between pulsating pressure and the powder that is loaded thereby.

The coaxial configuration of pressure line and filling line moreover has the result that a large ratio of cross-sectional surface area to free lateral cross-sectional site is adjusted for the filling line as a result of its annular cross-sectional shape. This determines the adhesion of the non-fluidized powder in the filling line so that the filling line can be furnished with an overall large cross-sectional surface area without the powder having the tendency to flow through on its own. In the fluidized state however, a comparatively large powder quantity can pass through which accelerates the filling process and therefore increases the number of cycles and economic efficiency of the arrangement.

In an advantageous further embodiment, the powder is stored at the inlet side of the filling line in a storage container wherein above the powder that is stored in the storage container a substantially constant atmospheric pressure exists. In this way, it is ensured that the powder flow is generated by the applied pulsating pressure alone and is independent of the ambient pressure. This is beneficial with respect to the metering precision. Moreover, since the pulsating pressure has the atmospheric ambient pressure as an average pressure, the average pressure difference between the powder topside and the powder bottom side is essentially zero so that undesirable air flow through the filling line is prevented.

Depending on the respective application, it may be expedient to apply the oscillating pressure by means of certain, in particular inert, gases. Preferably, the pressure line is an air conduit for transmitting oscillating air pressure so that the configuration as a whole can be kept simple and is suitable for the predominant number of powders to be processed and is economic with regard to use.

For generating the oscillating pressure, different devices are conceivable. In a preferred embodiment, an oscillating membrane is provided for this purpose. The latter is constructively simple in its configuration and is suitable for reliable permanent operation. In accordance with the principle of a speaker membrane, it can be, for example, electrochemically driven in a simple way.

Filling and volumetric metering can be realized directly in the metering container provided for the end user and customer, such as blisters, capsules, or the like. Preferably, the metering container is a transfer chamber that is calibrated with respect to the volume of its interior. The powder quantity that is metered by the calibrated volume is transferred from the transfer chamber into the final packaging unit such as blister, capsule or the like. In this way, an exact metering action is provided without requiring too much with respect to dimensional precision of the blister pack or the like.

BRIEF DESCRIPTION OF THE DRAWINGS

One embodiment of the invention will be explained in the following with the aid of drawing in more detail. It is shown in.

DESCRIPTION OF PREFERRED EMBODIMENTS

Figure 1:
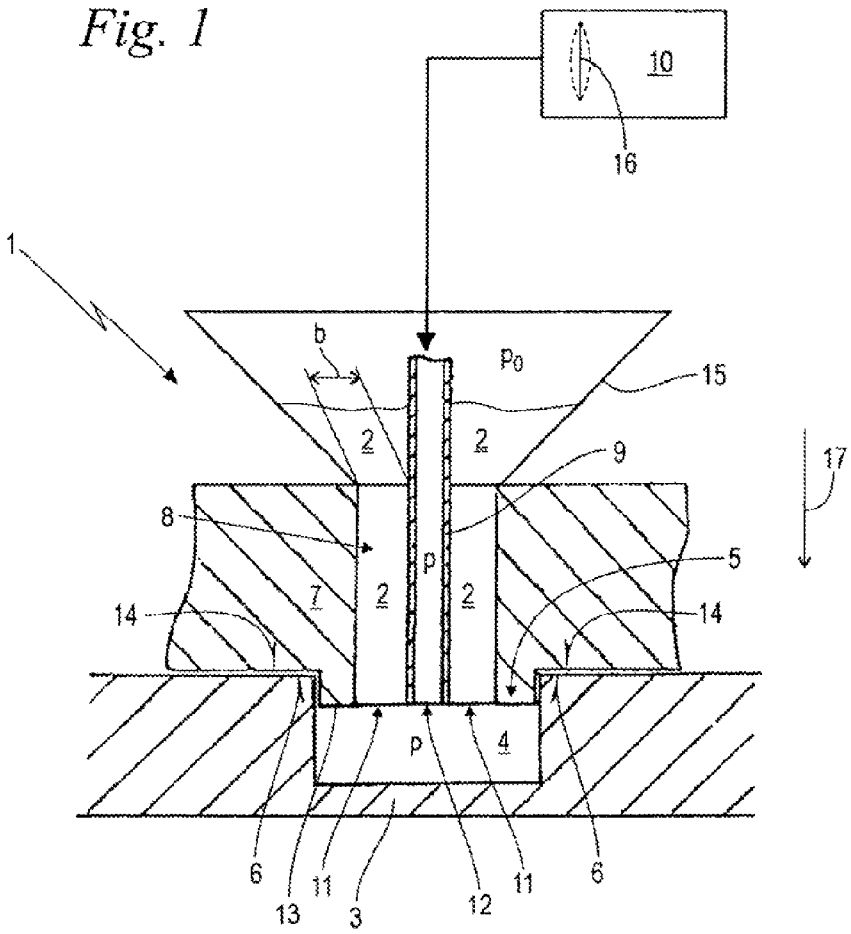
FIG. 1 in a schematic section illustration an embodiment of the filling assembly according to the invention with a central pressure line for introducing an oscillating air pressure into the metering container and with a filling line for the powder to be filled in that extends coaxially about the pressure line.

FIG. 1 shows in a schematic section illustration an embodiment of the filling assembly according to the invention. The filling assembly comprises a filling device 1 as well as a metering container 3 that is to be filled with the powder 2 by means of the filling device 1. By means of the illustrated filling assembly, the finely divided powder is filled into the interior 4 of the metering container 3 and is volumetrically metered by doing so.

The filling device 1 has a cover 7 and a filling line 8 passing through the cover 7. Moreover, a pressure line 9 is provided that also passes through the cover 7. The assembly is illustrated in its usual operating position relative to the direction of the force of gravity indicated by arrow 17. Relative to the direction of the force of gravity, above the filling line 8 a storage container 15 is provided from which the filling line 8 is extending downwardly through the cover 7. As a result of its inherent weight, the powder which is made available in the storage container 15 collects at the bottom of the storage container 15 as well as in the filling line 8 in the direction of the force of gravity indicated by arrow 17. The finely divided powder 2, because of its fine grain structure, has a tendency to form agglomerates so that, at rest, it is not dropping by its inherent weight alone through the filling line 8 downwardly into the interior 4 of the metering container 3. Rather, the free cross-sectional size b of the filling line 8 in the form of a lateral length is matched such to the properties and in particular to the grain size distribution of the powder 2 that the powder 2 at rest remains stuck within the filling line 8 when not externally excited.

Moreover, the filling device 1 has a pressure pulsation device 10 for generating an oscillating pressure p. For this purpose, an oscillating membrane 16 of the pressure pulsation device 10 is provided that, for example, is driven electromagnetically and that performs, starting from a central position indicated by a solid line, a translatory oscillation indicated by dashed lines. Instead of the bellied oscillation shape, an oscillation shape with an oscillation membrane 16 that as a whole is moved laterally transverse relative to its plane may be expedient also. The oscillating pressure p that is generated by the pressure pulsation device 10 or the oscillating membrane 16 is transmitted from the pressure pulsation device 10 through the pressure line 9 and through the cover 7 into the interior 4 of the metering container 3.

The metering container 3 is embodied open at one end and otherwise as a closed container wherein the open end in the form of a fill opening 5 is positioned at the top relative to the direction of the force of gravity. The fill opening 5 is surrounded by a circumferentially extending rim 6. The metering container 3 is designed separately from the stationary filling device 1 and is moveable relative to it. For the filling process, the metering container 3 is positioned with its fill opening 5 such underneath the cover 7 of the filling device 1 that the cover 7 is resting seal-tightly on the circumferentially extending rim 6 of the metering container 3 by means of a circumferentially extending sealing section 14 that surrounds the powder opening 11 at the container end and the pressure opening 12 of the pressure line 9 at the container end. Since the metering container 3 and also the cover 7 as a whole are seal-tight with respect to gas passage and also relative to passage of particles of the powder 2, in the illustrated filling configuration according to FIG. 1 the only connection of the interior 4 of the metering container 3 with the environment is provided by the filling line 8 and the pressure line 9.

Figure 2:
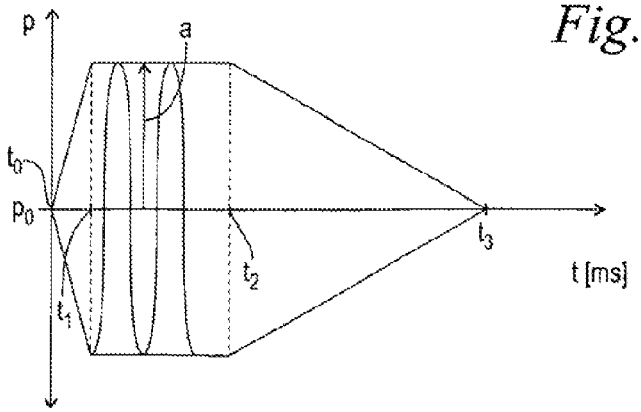
FIG. 2 in a diagram illustration an exemplary pressure course of the oscillating air pressure that is supplied by means of the pressure line according to FIG. 1 into the metering container.

The pressure p which is generated by the pressure pulsation device 10 is schematically shown in the diagram of FIG. 2 wherein the course of the pressure p is plotted relative to time. The oscillating pressure p has a maximum amplitude a by means of which it oscillates about the atmospheric ambient pressure $p_0$ as an average value. Upon turning on the pressure pulsation device 10, the pressure p in the pressure line 9 (FIG. 1) at the time $t_0$ is initially zero wherein the amplitude then during an initial phase up to the point in time $t_1$ increases to the maximum amplitude a. The pressure pulsation device 10 (FIG. 1) remains switched on up to the point in time $t_2$ during which time the amplitude a remains constant. After switching off at the point in time $t_2$, movement of the oscillating membrane 16 together with the oscillating pressure p generated by it subsides up to the point in time $t_3$.

In the storage container 15, above the powder 2 stored, therein a substantially constant atmospheric pressure $p_0$ exists and is therefore identical to the average value of the oscillating pressure p that is introduced by means of the pressure line 9 in the interior 4 of the metering container 3. Averaged across the course of the oscillating pressure p according to FIG. 2 there is thus a pressure balance above and below the powder 2. Therefore, on average, a balanced pressure balance in the interior 4 exists so that no continuous flow occurs therein. Local air flows are limited to the periodic, in sum however compensated, entry and exit of air through the pressure opening 12.

For filling the metering container 3 moved into the position according to FIG. 1, the pressure pulsation device 10 is started. It generates then the pressure course according to FIG. 2. The course of the pressure p is transmitted by means of the pressure line 9 into the interior 4 of the metering container 3. The amplitude a, the frequency, and the duration t of the oscillating pressure p (FIG. 2) act from the interior 4 through the powder opening 11 at the container end onto the powder 2 contained in the filling line 8 and are adjusted, taking into account the powder properties, such that the powder 2 is fluidized within the filling line 8. The oscillating pressure p which is acting on the powder 2 overcomes the cohesive forces existing within the powder 2 so that the powder 2, as a result of its inherent weight acting in the direction of the arrow 17, drops from the filling line 8 or the storage container 15 through the filling line 8 into the metering container 3.

The powder flows however only until either the interior 4 is completely filled or the pressure pulsation device 10 is switched off. In this way, different possibilities for filling the metering container 3 are provided as follows.

For filling up to the rim of the metering container 3, the cover 7, deviating from the illustration according to FIG. 1 can be configured to be flat at the side that is facing the metering container 3 wherein a central cover section 13 is located in the same plane as the circumferentially extending sealing section 14. The pressure pulsation device 10 generates the oscillating pressure p until the interior 4, delimited by the cover section 13 of the cover 17 and the walls of the metering container 3, is completely filled with the powder. Now the desired powder filling level in the metering container 3 is reached. Only thereafter, the pressure pulsation device 10 or the pressure p that is generated by it is switched off. The metering container filled in this way is then removed and subjected to further processing.

Alternatively, it may be expedient to fill the interior 4 of the metering container 3 only partially with the powder 2. This can be achieved in that the required time $t_2$ for partial filling is determined and the oscillating pressure p (FIG. 2) is switched off at the point of time $t_2$. After this time-controlled partial filling, the metering container 3 is then removed from underneath the filling device 1 and subjected to further processing.

Finally, there is also the possibility, illustrated in FIG. 1, of generating a filling level that deviates from that of the volume of the interior 4. For this purpose, the cover section 13 is height-offset relative to the surrounding sealing section 14 transversely or perpendicularly to the plane of the fill opening 5. In the illustrated embodiment, the height offset is selected such that the cover section 13 relative to the rim 6 projects into the interior 4 of the metering container 3 and therefore makes the nominal volume smaller relative to the plane of the rim 6. In this context, filling of the interior 4 is then performed in the above described way until the reduced interior 4 is completely filled, wherein the oscillating pressure p is switched off only subsequently. The subsequently removed metering container 3 is then only filled partially relative to the level of the circumferentially extending rim 6. After subsequently sealing the container 3 with a heat sealing film at the circumferentially extending rim 6, there remains, in addition to the volumetrically metered powder quantity, also a desired size of free space or air in the interior 4 of the metering container 3. Depending on the need, it may also be expedient to provide the height offset of the cover section 13 relative to the sealing section 14 in the reverse direction so that during the filling process an interior 4 enlarged relative to the nominal volume is produced and then a targeted over filling of the metering container 3 can be performed.

In the embodiment illustrated in FIG. 1, the pressure line 9 and the filling line 8 are arranged coaxially to each other. The radial inner pressure line 9 is surrounded by the radial outer filling line 8 in an annular shape. While the pressure line 9 has a circular cross-section, the free cross-section of the filling line 8 is of a circular ring shape. However, a reverse configuration may also be expedient wherein the filling line 8 extends within the pressure line 9. The free cross-sectional size b of the filling line 8, already described above, is in this context the radius difference between the inner radius of the filling line 8 and the outer radius of the pressure line 9. In another cross-sectional configuration of the filling line 8 that deviates from a circular ring shape, the cross-sectional size b is determined in a direction transverse to the passage axis; this size has a significant effect on the flowability of the powder 2 through the filling line 8. In case of an uninterrupted, for example, circular or elliptical cross-sectional shape, this is in general the length of the smallest cross-sectional axis. In any case, the cross-sectional size b is to be selected such that the powder 2, stored at rest in the storage container 15 and also in the filling line 8 and not subjected to oscillating pressure p, will not drop as a result of its inherent weight through the filling line 8 and fall out but remains stuck therein as a result of its agglomeration properties that, however, outflow of the powder 2 will happen as soon as the oscillating pressure p is acting. In adaptation to the afore described powder properties and grain size ranges, the free cross-sectional size b preferably is in a range of including 0.1 mm to including 5.0 mm, expediently from including 0.5 mm to including 2.0 mm, and especially in a range from including 1.0 mm to including 1.5 mm.

In deviation from the herein illustrated coaxial configuration, the filling line 8 and the pressure line 9 can however also be configured separate from each other and can extend at a spacing relative to each other through the cover 7. Their cross-sectional shape is not limited to the aforementioned possibilities but also can be matched in different ways to the respective requirements. Moreover, there is the possibility, for example, for filling elongate metering containers 3, to provide several filling lines 8 distributed across the surface of the fill opening 5 in order to reach also possibly existing corner areas of the interior 4 and in order to achieve a uniform filling level in the entire interior 4. Moreover, it may also be expedient to provide more than one pressure line 9.

In the illustrated embodiment, the pressure opening 12 of the pressure line 9 at the container end, relative to the direction of the force of gravity illustrated by arrow 17, is positioned at the same level as the powder opening 11 of the filling line 8 at the container end that is herein of a circular ring shape. In this connection, in the non-fluidized state the powder 2 contained in the filling line 8 forms at the powder opening 11 a planar circular ring-shaped surface onto which the oscillating pressure p will act. However, a configuration may be expedient also in which the pressure opening 12 is higher or lower than the powder opening 11. In this case, a somewhat conical action surface between the oscillating pressure p and the not yet fluidized, agglomerated powder 2 occurs in the area of the powder opening 11.

The pressure line 9 in the illustrated embodiment is an air conduit through which an oscillating air pressure is introduced into the interior 4 of the metering container 3 by the pressure pulsation device 10. Instead of air as a medium, another medium, for example, inert gas, can be selected also for certain critical applications.

The metering container 3 can be a precisely sized deep-drawn depression of a blister pack wherein metering of the powder 2 is then realized directly into the packaging provided for the user. After completed filling, the interior is then sealed along the circumferentially extending rim 6 with a heat sealing film, not illustrated, whereby the blister pack is then ready for use for the end user. In the same way, however, also filling of hard capsules or the like is possible. Alternatively, it may be expedient with respect to applications that are critical with respect to metering precision to design the metering container 3 as a transfer chamber that is calibrated with respect to the volume of its interior 4 as has been schematically indicated in FIG. 1. In it, the powder 2 is first exactly metered volumetrically in the above described way and only thereafter is then transferred into the packaging unit in the form of blisters, hard capsules or the like provided for the end user.

According to FIG. 1, in an exemplary fashion only the interaction of an individual filling device 1 with individual metering container 3 is illustrated. In practice, the arrangement of several such devices, for example, in a serial arrangement or matrix arrangement or also in the form of a rotary table, is expedient for simultaneous filling of several metering containers 3.

What is claimed is:

1. A filling assembly for volumetric metering of finely divided powder, the filling assembly comprising:

a filling device;

a metering container with an interior, a fill opening that provides access to the interior, and a rim circumferentially extending about the fill opening;

wherein the filling device comprises a cover and at least one filling line passing through the cover, wherein the cover, when filling the metering container, covers the fill opening and the rim, and wherein the filling line, when filling the metering container, opens into the interior;

at least one pressure line that passes through the cover;

wherein, when filling the metering container, the at least one pressure line opens into the interior;

a pressure pulsation device that generates an oscillating pressure oscillating about atmospheric ambient pressure as an average value, wherein the oscillating pressure is transmitted through the at least one pressure line into the interior.

2. The filling assembly according to claim 1, wherein the at least one pressure line passes coaxially through the at least one filling line.

3. The filling assembly according to claim 1, wherein the at least one filling line has a powder opening at an end that opens into the interior and the at least one pressure line has a pressure opening at an end that opens into the interior, wherein the powder opening and the pressure opening are at a same height relative to a direction of gravity in an operation-ready position of the filling assembly.

4. The filling assembly according to claim 1, wherein the cover has a cover section and a sealing section, wherein the cover section is positioned in the area of the fill opening of the metering container and is surrounded in the area of the rim of the metering container by the sealing section, wherein the cover section is height-offset relative to the sealing section.

5. The filling assembly according to claim 1, further comprising a finely divided power, wherein a free cross-sectional size of the at least one filling line is matched to properties of the powder such that the powder, when the pressure pulsation device is switched off, does not fall through the at least one filling line as a result of the inherent weight of the powder.

6. The filling assembly according to claim 5, wherein the powder has a grain size in a range of including 1 μm to including 200 μm and the free cross-sectional size is in a range of including 0.1 mm to including 5.0 mm.

7. The filling assembly according to claim 6, wherein the powder has a grain size in a range of including 1 μm to including 80 μm.

8. The filling assembly according to claim 6, wherein the free cross-sectional size is in a range of including 0.5 mm to including 2.0 mm.

9. The filling assembly according to claim 8, wherein the free cross-sectional size is in a range of including 1.0 mm to including 1.5 mm.

10. The filling assembly according to claim 5, comprising a storage container connected to an inlet side of the at least one filling line, the inlet side being remote from the metering container, wherein the powder is stored in the storage container and, above the powder stored in the storage container, a substantially constant atmospheric pressure exists.

11. The filling assembly according to claim 1, wherein the at least one pressure line is an air conduit that transmits an oscillating air pressure.

12. The filling assembly according to claim 1, wherein the pressure pulsation device comprises an oscillating membrane that generates the oscillating pressure.

13. The filling assembly according to claim 1, wherein the metering container is a transfer chamber and the interior of the metering chamber has a calibrated volume.

14. A method for operating a filling assembly according to claim 1, comprising:

providing a powder at rest within a storage container that is connected to an inlet side of at least one filling line and within the at least one filling line such that the powder does not fall as a result of the inherent weight of the powder through the at least one filling line;

positioning a metering container with a fill opening underneath a cover of a filling device such that a sealing section of the cover is resting seal-tightly on a rim of the metering container and the at least one filling line opens into an interior of the metering container;

providing at least one pressure line that opens into the interior of the metering container;

generating with a pressure pulsation device an oscillating pressure that oscillates about an atmospheric ambient pressure as an average value and transmitting the oscillating pressure through the at least one pressure line into the interior of the metering container;

adjusting amplitude, frequency and duration of the oscillating pressure such that the powder in the filling line is fluidized and, as a result of the inherent weight, falls through the at least one filling line into the metering container;

switching off the oscillating pressure after reaching a desired powder filling level in the metering container; and removing the metering container filled with the powder from the filling device.

15. The method according to claim 14, wherein the interior of the metering container delimited by a cover section of the cover is completely filled with the powder and after complete filling, corresponding to the desired powder filling level, the oscillating pressure is switched off.

16. The method according to claim 14, wherein the interior of the metering container delimited by a cover section of the cover is filled partially with the powder and, after a time that predetermines the partial filling, corresponding to the desired powder filling level, the oscillating pressure is switched off.

* * * * *